US006145997A

United States Patent [19]

Sedovic et al.

[11] Patent Number: 6,145,997

[45] **Date of Patent: *Nov. 14, 2000**

[54] FLASHLIGHT HAVING BATTERY SUSPENSION SYSTEM

[75] Inventors: John August Sedovic; David J. Bamber, both of Wichita, Kans.; Michael Chan, Kowloon, The Hong Kong Special Administrative Region of the People's Republic of China

[73] Assignee: The Coleman Company, Inc.

[ * ] Notice: This patent issued on a continued prosecution application filed under 37 CFR 1.53(d), and is subject to the twenty year patent term provisions of 35 U.S.C. 154(a)(2).

[21] Appl. No.: 08/943,548

[22] Filed: Oct. 3, 1997

[51] Int. Cl.[7] ..... F21L 7/00

[52] U.S. Cl. ..... 362/208; 362/202; 362/390

[58] Field of Search ..... 362/390, 369, 362/202, 203, 205, 208

[56] References Cited

U.S. PATENT DOCUMENTS

| | | | |
|---|---|---|---|
| 1,144,201 | 6/1915 | Hipwell | 362/203 |
| 1,336,067 | 3/1920 | Burgess | 362/187 |
| 1,372,851 | 3/1921 | Vreeland | 362/205 |
| 1,621,610 | 3/1927 | Sokolow | 362/202 |
| 4,527,223 | 7/1985 | Maglica | 362/187 |
| 4,807,097 | 2/1989 | Gammache | 362/202 |
| 4,951,183 | 8/1990 | Wang | 362/187 |
| 5,353,208 | 10/1994 | Moore | 362/202 |
| 5,390,091 | 2/1995 | Maglica | 362/205 |
| 5,593,222 | 1/1997 | Maglica | 362/202 |

*Primary Examiner*—Nimeshkumar D. Patel
*Assistant Examiner*—Todd Reed Hopper
*Attorney, Agent, or Firm*—Kramer Levin Naftalis Frankel LLP

[57] ABSTRACT

A flashlight having a battery suspension system is provided and includes a flashlight body having a substantially hollow portion into which at least one battery may be loaded; an end cap removably mountable to one longitudinal end of the flashlight body; a head assembly removably mountable to another longitudinal end of the flashlight body opposite the one longitudinal end; a first spring disposed adjacent the end cap and extending in an axial direction of the flashlight body; a second spring disposed adjacent the head assembly and extending in the axial direction of the flashlight body; and a plate member disposed with one surface in contact with the second spring, and another surface facing toward the first spring.

18 Claims, 3 Drawing Sheets

FLASHLIGHT HAVING BATTERY SUSPENSION SYSTEM

BACKGROUND OF THE INVENTION

The present invention relates to a flashlight having a battery suspension system. More specifically, the battery suspension system of the present invention protects the flashlight batteries from excessive physical shock when, for example, the flashlight is bumped or dropped. Further, the present invention helps to ensure that, when the flashlight is switched to the on position, an electrically conductive path is maintained even if the flashlight is bumped or dropped.

Conventional flashlights are designed to have a substantially hollow flashlight body that provides a handle with which to grip the flashlight, and provides a housing for receiving the battery or batteries, which are the electrical power source for the flashlight. Typically, the batteries are loaded into the flashlight body end to end so as to be electrically in series. Often the flashlight will include an end cap and a head assembly, either or both of which are removably mountable to the flashlight body. The head assembly houses a lens, a reflector, and a light bulb socket into which a light bulb is mountable. In order to illuminate the light bulb, a closed electrical circuit between the batteries and the light bulb must be provided to allow electrical current to flow through the light bulb filament.

Normally, the closed electrical circuit includes the center electrode of the foremost battery mounted in the flashlight body, an electrically conductive path from this center electrode to a first terminal of the flashlight bulb, and an electrically conductive path from a second terminal of the flashlight bulb to the terminal electrode of the rearmost battery mounted in the flashlight body. The batteries are connected in series by aligning the center electrode of a rearward battery to the terminal electrode of a forward battery. A switch for interrupting the electrical circuit is disposed at some point in the circuit so that the flashlight may be turned on and off, as desired.

In an effort to secure the electrical connection between the batteries themselves, and between the interface between the batteries and the remainder of the electrical circuit, it is known to provide a conductive spring at the base of the rearmost battery and/or at the top of the foremost battery. Such a spring (or springs) acts to urge the batteries in the longitudinal direction of the flashlight body. Further, such a spring (or springs) may be somewhat effective to isolate the batteries from physical shock due to bumping or dropping of the flashlight.

Such conventional battery suspension systems, however, suffer from a number of drawbacks. For example, often there is provided only a single conductive spring at the base of the rearmost battery, while the center electrode projection of the foremost battery abuts against a non-yielding electrical contact. Such an arrangement offers only limited shock absorption, and is likely to transmit force due to shock to the center electrode projection of the foremost battery. The center electrode projection creates a load path to the battery that makes the battery particularly susceptible to damage. Such damage may cause malfunction of the flashlight or, with some batteries, may cause leakage of toxic substances.

Even when conductive springs are provided at each end of the battery stack, it is often the case that the forward conductive spring has a base diameter that substantially equals the diameter of the center electrode projection of the foremost battery. Such an arrangement concentrates any force that is transmitted to the battery onto this center electrode projection, which, as stated above, tends to be a vulnerable portion of the battery and is likely to transmit damaging forces to the battery. Moreover, because the batteries are likely to experience some radial movement when the flashlight is dropped or jostled, such a forward conductive spring is likely to slip off or otherwise lose contact with the center electrode projection of the foremost battery, interrupting the electrical circuit and causing flashlight malfunction.

SUMMARY OF THE INVENTION

Accordingly, the present invention provides a battery suspension system for a flashlight that effectively protects the batteries from excessive physical shock, and helps to reliably maintain an electrically conductive path even when the batteries are jostled or displaced within the flashlight body.

In one aspect, the present invention relates to a flashlight with a battery suspension system having a first spring for urging at least one battery in a first direction, and a second spring for urging the at least one battery in a second direction that is opposite to the first direction. This embodiment of the present invention also includes a plate member disposed with a first surface in contact with the second spring, and a second surface in contact with the at least one battery.

In another aspect, the present invention relates to a flashlight having a battery suspension system that includes a flashlight body having a substantially hollow portion into which at least one battery may be loaded. A head assembly is removably mountable to one longitudinal end of the flashlight body that is opposite another longitudinal end adjacent which a first spring is disposed. The first spring extends in an axial direction of the flashlight body, and a second spring, which is disposed adjacent the head assembly, also extends in the axial direction. A plate member is disposed with one surface in contact with the second spring, and another surface facing toward the first spring.

In yet another aspect, the plate member in this embodiment of the present invention has a rearward annular projection formed so as to extend toward the first spring. The plate member further includes a conductive, elastically flexible inlay disposed on a surface of the plate member that contacts a center electrode projection of the at least one battery to form a plate electrode. When the inlay is subjected to mechanical shock, the inlay elastically deflects so that the rearward annular projection contacts the at least one battery.

These and other aspects and features of the present invention will become apparent from the following detailed description of the preferred embodiments of the present invention, read in conjunction with reference to the accompanying drawings.

DETAILED DESCRIPTION OF THE PREFERRED EMBODIMENTS

The present invention provides a flashlight battery suspension system that effectively isolates the flashlight batteries from physical shock, and helps to ensure a reliable electrically conductive path.

Figure 1:
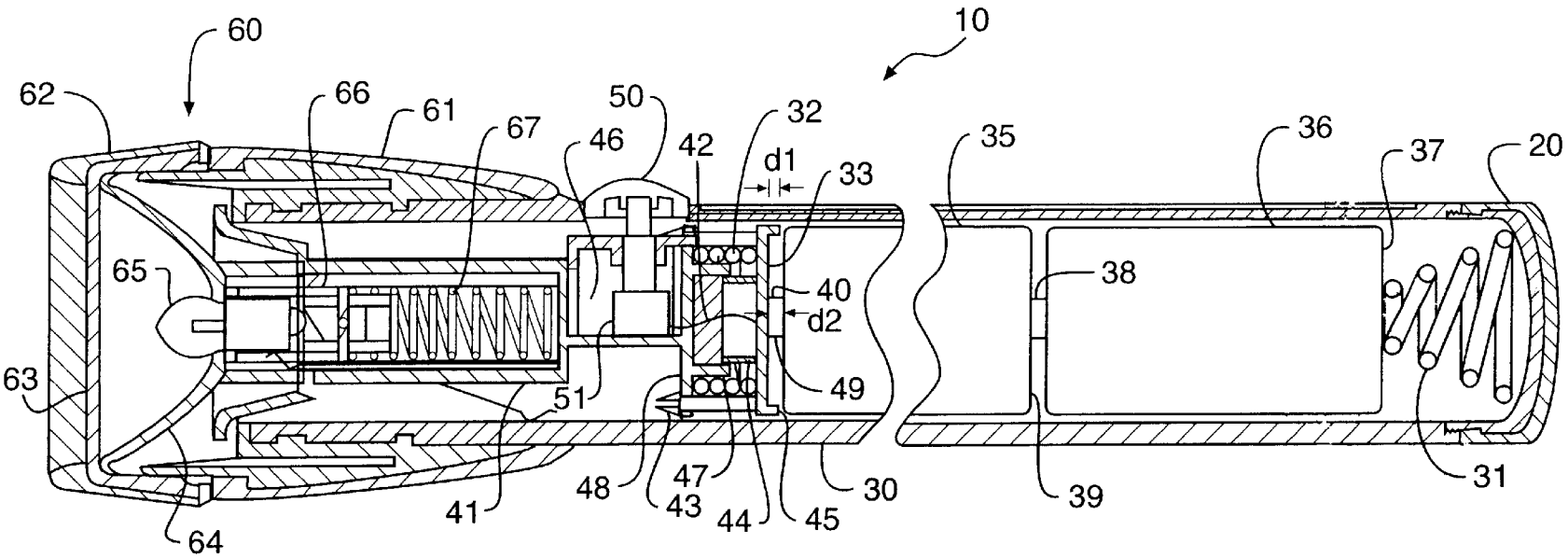
FIG. 1 shows a cross-sectional view of a flashlight as an embodiment of the present invention.
Figure 2:
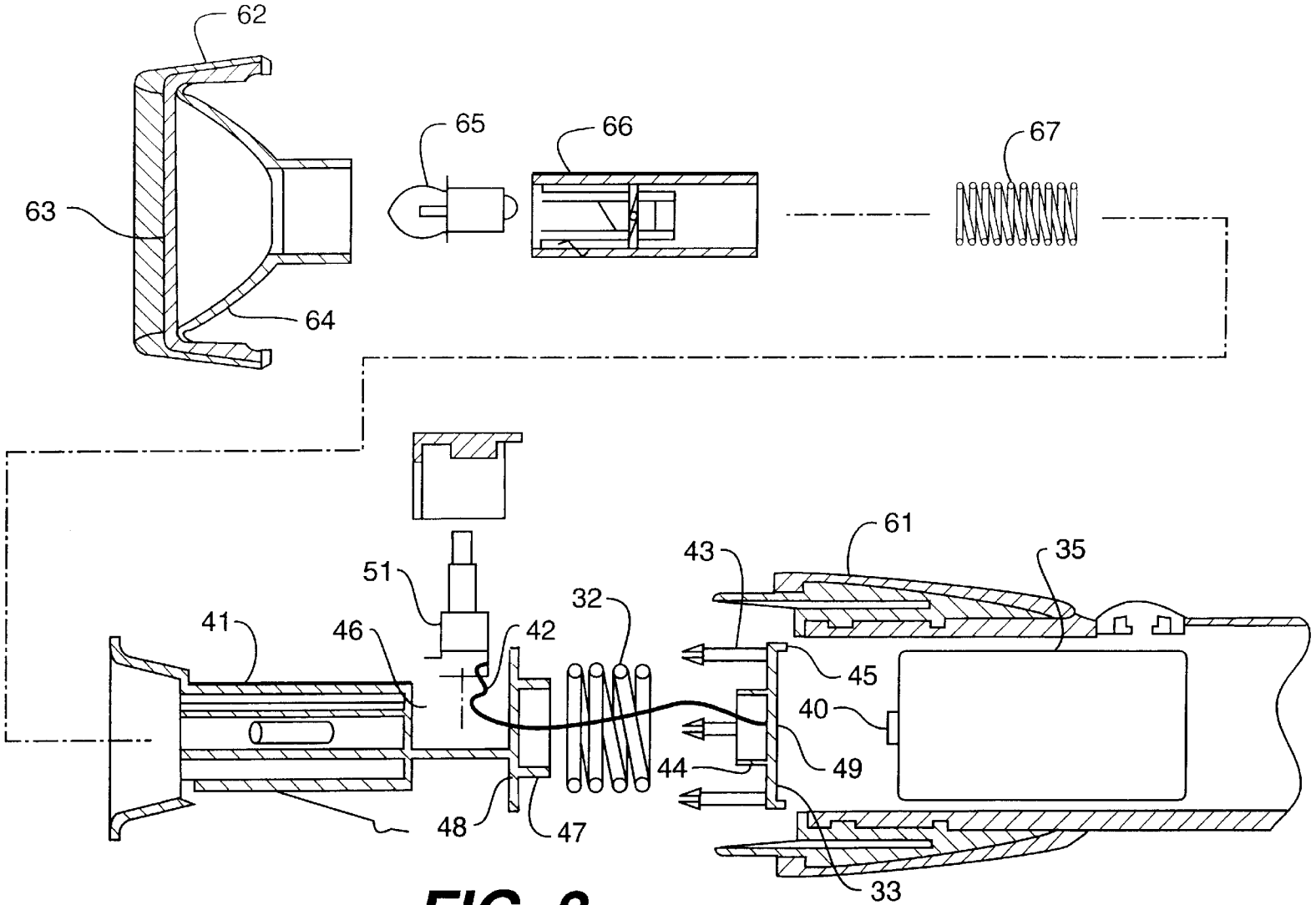
FIG. 2 depicts an exploded view of a top portion of the battery suspension system of the flashlight depicted in FIG. 1.

As depicted in FIG. 1, a flashlight 10 includes a flashlight body 30, a head assembly 60, and an end cap 20. The head assembly 60 includes an upper head assembly 62 and a lower head assembly 61 and supports, inter alia, a lens 63 and a reflector 64. The lower head assembly 61 includes internal threads that mate with external threads on the forward longitudinal end of the flashlight body 30, so that the head assembly 60 is removably mountable to the flashlight body 30. Similarly, the end cap 20 includes external threads that mate with internal threads on the rearward longitudinal end of the flashlight body 30, so that the end cap 20 is removably mountable to the flashlight body 30. The flashlight body 30, the end cap 20, and the head assembly 60 may be made from any appropriate material such as, for example, metal, plastic, composite resin, or any combination thereof.

An inner support member 41 is fixed inside the flashlight body 30 near the longitudinal end of the flashlight body 30 at which the head assembly 60 is mounted. A spring 67 is fitted into the inner support member 41 so as to urge a light bulb socket 66 and a light bulb 65 in an axial direction of the flashlight body 30. The relative position between the light bulb 65 and the reflector 64 may be changed by rotating the upper head assembly 62 relative to the lower head assembly 61. In this manner, the pattern of illumination from the light bulb 65 may be altered from spot to flood, as desired.

The inner support member 41 includes a switch mounting portion 46 at its rearward end, which is designed to accommodate a switch assembly 51. The switch assembly 51 is activated by a switch button 50. Successively pressing the switch button 50 is effective to open and close an electrically conductive path between the flashlight batteries 35, 36 and the light bulb 65. The electrically conductive path includes a wire 42 that extends between the switch assembly 51 and an electrode contact 49 that contacts the center electrode projection 40 of the forward battery 35 (discussed below), and may or may not include the flashlight body 30.

The inner support member 41 also includes base plate 48 that is formed rearwardly of the switch mounting portion 46. Extending from the base plate 48 in a rearward direction of the flashlight 10 is a spring positioning portion 47 formed as an annular projection. The spring positioning portion 47 is the interface between the inner support member 41 and other members of the battery suspension system.

The battery suspension system of the flashlight 10 includes, inter alia, a rearward spring 31, a floating plate 33, and a forward spring 32. Although the rearward spring 31 may be loose, it is preferable for it to be captured in the end cap 20. For example, the rearward spring 31 may be integrally formed with the end cap 20, may be bonded thereto, or may be captured using an appropriate retaining member or technique. Although in this embodiment the rearward spring 31 is made of an electrically conductive material and is part of the electrically conductive path of the flashlight 10, the present invention is not so limited.

Figure 3:
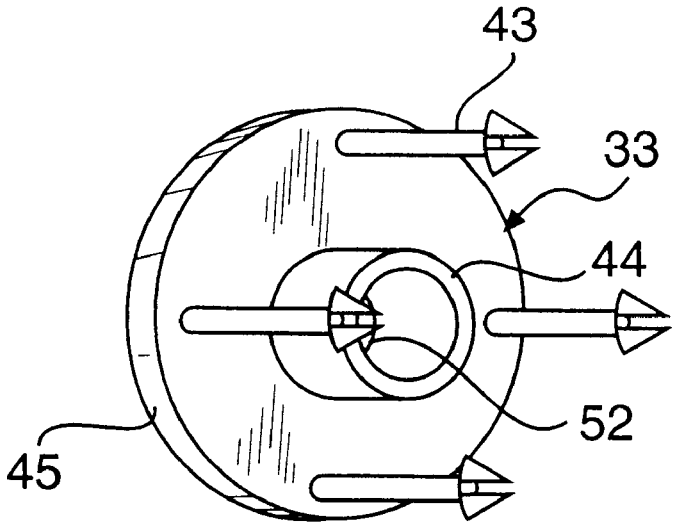
FIG. 3 depicts a perspective view of a forward side of a floating plate of the battery suspension system of the flashlight depicted in FIG. 1.
Figure 4:
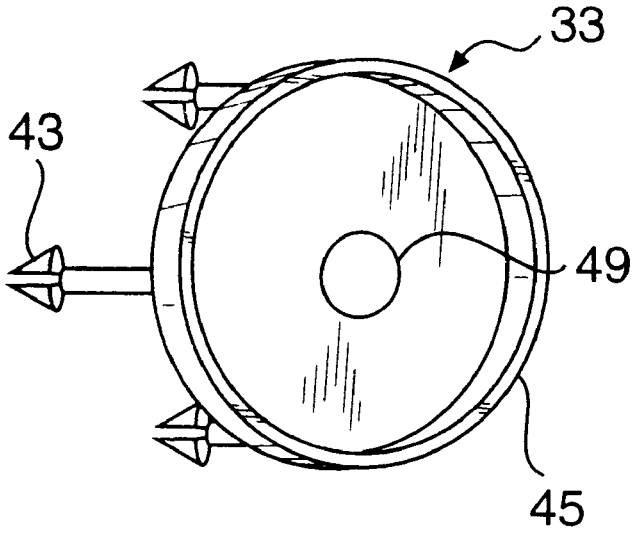
FIG. 4 depicts a perspective view of a rearward side of a floating plate of the battery suspension system of the flashlight depicted in FIG. 1.

The floating plate 33 is the interface between the forward battery 35 and the forward spring 32. The floating plate 33 includes posts 43 that project from a forward surface of the floating plate 33 towards the forward end of the flashlight (FIG. 3). The posts 43 may be snapped or otherwise fitted into corresponding holes formed in the base plate 48 of the inner support member 41. Although this embodiment includes four such posts, the present invention is not limited to this number. The forward surface of the floating plate 33 also includes a forward annular projection 44 that extends toward the forward end of the flashlight 10. Extending from a rearward surface of the floating plate 33 is a rearward annular projection 45 (FIG. 4). An inlay 52 of conductive material is inlayed, set, or otherwise disposed in the center of the floating plate to form a plate electrode, as discussed below. The inlay 52 may be made from any suitable conductive material, but is designed to have some flexure. The floating plate 33 may be made from any appropriate material such as, for example, metal, plastic, composite resin, or any combination thereof, but is preferably than the inlay 52.

The forward spring 32 is retained in the flashlight body 30 between the forward annular projection 44 of the floating plate 33 and the spring positioning portion 47 of the inner support member 41. Because the inner diameter of the forward spring 32 is greater than or equal to the outer diameters of the spring positioning portion 47 and the forward annular projection 44, the forward spring 32 may be fit over both of these. The posts 43 of the floating plate 33 may then be snapped or otherwise fitted into corresponding holes formed in the base plate 48 of the inner support member 41 to thereby capture the forward spring 32. The corresponding holes in the base plate 48 are sized to allow the posts 43 to slide therethrough, while the heads of the posts must be compressed to fit therethrough. In this manner, the floating plate 33 is able to "float" in the axial direction of the flashlight body 30 in conjunction with expansion and contraction of the forward spring 32.

As stated above, the wire 42 extends between the switch assembly 51 and the electrode contact 49 of the floating plate 33. More specifically, the wire 42 may be soldered or otherwise fixed to the switch assembly 51, passed through a hole formed in the base plate 48 of the inner support member 41 (or otherwise around the base plate 48), and passed through the interior of the forward spring 32. The wire 42 may be soldered or otherwise fixed to the inlay 52 of conductive material set in the floating plate 33, to form the electrode contact 49. The diameter of the inlay 52, and, thus, the electrode contact 49, is preferably made to be larger than the diameter of the center electrode projection 40 of the forward battery 35. Alternatively, the entire floating plate 33 may be made from a conductive material, and the wire may be attached to any portion thereof.

By removing the end cap 20 from the flashlight body 30, the batteries 35, 36 may be loaded into the flashlight body 30 as depicted in FIG. 1. When the end cap 20 is screwed onto the flashlight body 30, the batteries 35, 36 are positioned electrically in series between the electrode contact 49 of the floating plate 33 and the rearward spring 31. As is clear from FIG. 1, the rearward spring 31 contacts the terminal electrode 37 of the rearward battery 36 and urges the rearward battery 36 in the longitudinal direction of the flashlight body 30 toward the head assembly 60. The center electrode projection 38 of the rearward battery 36 is thus urged against the terminal electrode 39 of the forward battery 35.

The forward spring 32, positioned by the forward annular projection 44 and the spring positioning portion 47, contacts the front surface of the floating plate 33 and urges the floating plate 33 toward the end cap 20. The inlay 52 forming the electrode contact 49 of the floating plate 33 is thus urged against the center electrode projection 40 of the forward battery 35. At the position where the forward spring 32 presses against the front side (or surface) of the floating plate 33, the outer diameter of the forward spring 32 is preferably larger than the diameter of a center electrode projection 40 of the forward battery 35 and is smaller than the diameter of the floating plate 33.

In this manner, the batteries 35, 36 are suspended in the flashlight body 30 between the springs 31, 32, and are urged against each other. Because the batteries 35, 36 are suspended by both a forward spring 32 (through the floating plate 33) and a rearward spring 31, they have limited freedom to move forward and backward in the longitudinal direction of the flashlight body 30 so as to effectively absorb physical shock due to dropping, bumping, jostling, etc. of the flashlight 10.

As depicted in FIG. 4, the rearward annular projection 45 projects from the rearward side of the floating plate 33 by a distance d1, which is less than a distance d2 (FIG. 1) that the center electrode projection 40 projects from a top surface of the battery 35. Because the inlay 52 is formed from a material having some flexure, only a small amount of force due to physical shock will be transmitted to the center electrode projection 40 before the inlay 52 elastically yields. Upon yielding to such a force, the rearward annular projection 45 of the floating plate 33 comes into contact with a forward surface, toward the outer perimeter, of the casing of the battery 35, thus creating a load path that includes the circumferential surface of the outer casing. In this manner, the center electrode projection 40 is further protected from excessive force due to physical shock, which can damage the batteries and cause malfunction of the flashlight.

The floating plate 33 is also effective to maintain the integrity of the electrically conductive path to ensure continuous illumination when the flashlight is turned on, even if the flashlight is dropped or jostled. As stated above, the electrode contact 49 of the floating plate 33 has a diameter that is larger than that of the center electrode projection 40 of the forward battery 35. Therefore, even if the center electrode projection 40 moves in the radial direction of the flashlight body 30, it does not become displaced from, or slip off of, the electrode contact 49. Accordingly, even if the center electrode projection 40 is displaced in the radial direction, such displacement does not cause a break in the electrically conductive path. Such an arrangement also allows for a relaxation in tolerances when manufacturing the flashlight, without any sacrifice in the performance of the flashlight.

Although the foregoing embodiment of the present invention includes two batteries mounted in series, the present invention is not so limited. The advantages of the battery suspension system of the present invention would provide similar benefits to a flashlight having a single battery, or to a flashlight having more than two batteries.

Moreover, while the present invention has been described with respect to what is presently considered to be the preferred embodiments, the present invention is not limited to the disclosed embodiments. Rather, the present invention covers various modifications and equivalent arrangements included within the spirit and scope of the appended claims. The scope of the appended claims is to be accorded the broadest interpretation so as to encompass all such modifications and equivalent structures and functions.

What is claimed is:

1. A flashlight having a battery suspension system comprising:

first urging means for urging at least one battery in a first direction;

second urging means for urging the at least one battery in a second direction that is opposite to the first direction; and interference means for interfacing between said second urging means and the at least one battery, said interface means including an electrical contact for electrically contacting the at least one battery and a projecting portion for physically contacting the at least one battery when the interface means is subjected to mechanical shock.

2. A flashlight according to claim 1, wherein said projecting portion includes a rearward annular projection extending from a rear surface thereof toward said first urging means.

3. A flashlight according to claim 2, wherein said interface means includes a conductive, elastically flexible inlay and a front surface that is in contact with said second urging means, wherein said inlay is disposed on an area of said interface means that contacts a center electrode projection of the at least one battery so as to form an electrode, and wherein said interface means is slidably mounted to move forwardly and rearwardly within said battery suspension system.

4. A flashlight according to claim 3, wherein, when said interface means is subjected to mechanical shock, said inlay elastically deflects so that said rearward annular projection contacts the at least one battery.

5. A flashlight according to claim 4, wherein said rearward annular projection extends from said rear surface of said interface means a distance that is less than a distance that the center electrode projection of the at least one battery extends from a top surface of the at least one battery, and wherein said rearward annular projection has an outer diameter that is substantially the same as an outer diameter of the at least one battery.

6. A flashlight according to claim 5, further comprising an inner support member having a positioning annular projection and having a plurality of holes formed therein, wherein said interface means further includes a forward annular projection and a plurality of posts formed on said front surface thereof, and wherein said second urging means is retained between said positioning annular projection and said forward annular projection by removably inserting said plurality of posts into said plurality of holes formed in said inner support member.

7. A flashlight having a battery suspension system comprising:

a first spring for urging at least one battery in a first direction;

a second spring for urging the at least one battery in a second direction that is opposite to the first direction; and a plate member disposed with a first surface thereof in contact with said second spring and a second surface thereof including an electrical contact for making electrical contact with the at least one battery and a projecting portion for making physical contact with the at least one battery when the plate member is subjected to mechanical shock.

8. A flashlight according to claim 7, wherein said projecting portion is a rearward annular projection extending from said second surface toward said first spring.

9. A flashlight according to claim 8, wherein said plate member further includes a conductive, elastically flexible inlay disposed on an area of said second surface that contacts a center electrode projection of the at least one battery.

10. A flashlight according to claim 9, wherein, when said plate member is subjected to mechanical shock, said inlay elastically deflects so that said rearward annular projection contacts the at least one battery.

11. A flashlight according to claim 10, wherein said rearward annular projection extends from said second surface of said plate member a distance that is less than a distance that the center electrode projection of the at least one battery extends from a top surface of the at least one battery, and wherein said rearward annular projection has an outer diameter that is substantially the same as an outer diameter of the at least one battery.

12. A flashlight according to claim 11, further comprising an inner support member having a positioning annular projection and having a plurality of holes formed therein, wherein said plate member further includes a forward annular projection and a plurality of posts formed on said first surface thereof, and wherein said second spring is retained between said positioning annular projection and said forward annular projection by removably inserting said plurality of posts into corresponding ones of said plurality of holes such that said plate member is slidably mounted to said inner support member.

13. A flashlight having a battery suspension system comprising:

a flashlight body having a substantially hollow portion into which at least one battery may be loaded;

a head assembly mounted to one longitudinal end of said flashlight body opposite another longitudinal end;

a first spring disposed adjacent said another longitudinal end and extending in an axial direction of said flashlight body;

a second spring disposed adjacent said head assembly and extending in the axial direction of said flashlight body; and a plate member disposed with a first surface thereof in contact with said second spring, and having a second surface thereof facing toward said first spring, said plate member including an electrical contact for making electrical contact with the at least one battery and a projecting portion for physically contacting the at least one battery when the plate member is subjected to mechanical shock.

14. A flashlight according to claim 13, wherein said projecting portion is a rearward annular projection extending from said second surface thereof toward said first spring.

15. A flashlight according to claim 14, wherein said plate member includes a conductive, elastically flexible inlay disposed on an area of said second surface that contacts a center electrode projection of the at least one battery to form a plate electrode.

16. A flashlight according to claim 15, wherein, when said plate member is subjected to mechanical shock, said inlay elastically deflects so that said rearward annular projection contacts the at least one battery.

17. A flashlight according to claim 16, wherein said rearward annular projection extends from said second surface a distance that is less than a distance that a center electrode projection of a battery, which is loaded into said substantially hollow portion of said flashlight body, extends from a top surface of the battery; and wherein said rearward annular projection has an outer diameter that is substantially the same as an outer diameter of the battery.

18. A flashlight according to claim 17, further comprising an inner support member having a positioning annular projection and having a plurality of holes formed therein, wherein said plate member further includes a forward annular projection and a plurality of posts formed on said first surface thereof, and wherein said second spring is retained between said positioning annular projection and said forward annular projection by removably inserting said plurality of posts into corresponding ones of said plurality of holes such that said plate member is slidably mounted to said inner support member.

* * * * *